United States Patent [19]

McDowell

[11] Patent Number: 4,766,638

[45] Date of Patent: Aug. 30, 1988

[54] FOUR-WAY VACUUM CLEANER

[75] Inventor: David E. McDowell, Grand Rapids, Mich.

[73] Assignee: Bissell Inc., Grand Rapids, Mich.

[21] Appl. No.: 21,635

[22] Filed: Mar. 4, 1987

[51] Int. Cl.[4] ..... A47L 9/00

[52] U.S. Cl. ..... 15/329; 15/344; 15/350; 15/410; 15/414

[58] Field of Search ..... 15/414, 329, 344, 350, 15/410

[56] References Cited

U.S. PATENT DOCUMENTS

| | | | |
|---|---|---|---|
| D. 274,381 | 6/1984 | Chiu | D32/18 |
| D. 274,382 | 6/1984 | Cousins et al. | D32/18 |
| D. 277,706 | 2/1985 | Wareham | D32/18 |
| D. 279,513 | 7/1985 | Rinaldi et al. | D32/18 |
| D. 280,033 | 8/1985 | Miyamoto et al. | D32/18 |
| D. 280,142 | 8/1985 | Pudwill | D32/18 |
| D. 280,452 | 9/1985 | Arita . | |
| D. 280,453 | 9/1985 | Tsuji . | |
| 1,156,235 | 10/1915 | Kirby | 15/329 X |
| 1,558,006 | 10/1925 | Fisker . | |
| 2,986,765 | 6/1961 | Ernolf et al. | 15/329 |
| 3,193,992 | 7/1965 | Findley et al. . | |
| 3,758,914 | 9/1973 | Nupp et al. . | |
| 4,011,624 | 3/1977 | Proett | 15/344 |
| 4,204,298 | 5/1980 | Handa et al. . | |
| 4,209,875 | 7/1980 | Pugh et al. | 15/344 |
| 4,302,225 | 11/1981 | Eckart et al. . | |
| 4,406,559 | 9/1983 | Geertsema et al. | 15/145 X |
| 4,536,914 | 8/1985 | Levine . | |
| 4,542,557 | 9/1985 | Levine . | |
| 4,573,237 | 3/1986 | Kochte et al. | 15/344 |
| 4,610,048 | 9/1986 | Ishihara et al. | 15/414 X |
| 4,635,315 | 1/1987 | Kozak | 15/344 X |

FOREIGN PATENT DOCUMENTS

| | | | |
|---|---|---|---|
| 980285 | 1/1965 | United Kingdom | 15/329 |

OTHER PUBLICATIONS

Conair Aqua Sweep, Model HV2 Brochure.
International Consumer Brands Price List (effective Nov. 1, 1985).
Regina Cordless ElectrikBroom, Model RB02006-A-O Brochure.
The Eureka Quick Up, Model 90 Brochure.
Moulinex Hamilton Beach, Scovill Brochure.

*Primary Examiner*—Chris K. Moore
*Attorney, Agent, or Firm*—Price, Heneveld, Cooper, DeWitt & Litton

[57] ABSTRACT

A multi-use vacuum cleaner has a central body which houses a motor, air impeller, battery and a dirt collection chamber. One end of the central body has a face inclined to the longitudinal axis of the central body with a rectangular inlet orifice into which the coupling nozzle of a floor and carpet pickup head can be frictionally inserted. The other end of the body has an integral, axially protruding extension providing a primary handle for manipulating the body as a hand held cushion and upholstery cleaner. The primary handle has means for detachably mounting an extension handle permitting the unit to be used as a standard upright vacuum cleaner or for vacuuming overhead and other areas which would be otherwise inaccessible.

23 Claims, 3 Drawing Sheets

FOUR-WAY VACUUM CLEANER

FIELD OF THE INVENTION

This invention relates to a light duty and weight, combination floor vacuum cleaner, duster and upholstery and stair tread cleaner.

BACKGROUND OF THE INVENTION

A variety of different dry type vacuum cleaners are available for a variety of uses ranging from heavy duty rug and carpet cleaners, light duty rug and carpet cleaners for picking small spills and crumbs, compact hand held cleaners for cleaning cushions, pillows, stair treads and the like. There have also been developed such cleaners particularly designed or equipped with conversion tools to be used for special purposes such as removal of spider webs near the ceiling and adjusting drapery valances and the like.

In recent years due to the introduction of plastics and substantial improvements in the design of the electric motors for this type of equipment, the bulk and weight of these machines has been reduced substantially. Also, the development of compact rechargeable, heavy duty batteries has made possible the so-called cordless vacuum cleaner. However, there has remained the problem that the machines were limited to one or two functions. For other functions it has been necessary to have a second tool or a bulky and clumsy conversion kit.

An example of a basically single function, floor cleaning vacuum cleaner not suitable for use with cushions or well adapted for cleaning valances or removal of cobwebs close to the ceiling is disclosed in U.S. Pat. No. Des. 280,033, issued Aug. 6, 1985 to Isshin Miyamoto et al. Other examples of a basically single purpose machine are disclosed in U.S. Pat. No. 4,011,624 issued Mar. 15, 1977 to Mark A. Proett and U.S. Pat. No. Des. 274,381 issued June 19, 1984 to Lawrence I. Chiu. In both cases, these machines could be used to remove a floor spill but the use would require the operator to stoop or to kneel on the floor, either of which is inconvenient at best, and for some people, physically impossible.

The necessity for having different machines available to satisfy the needs of different circumstances is expensive and for many people creates a problem with storage space. It can also be frustrating when part way through a particular job one finds that a second and different tool is necessary to complete it.

BRIEF DESCRIPTION OF THE INVENTION

Through a unique "tool within a tool" and "handle within a handle" construction, the invention provides, in a single machine a vacuum cleaner which, without the need of a conversion kit or tray of accessories functions as a full height floor vacuum, a compact hand held upholstery cleaner and a machine having the ability to be used for cleaning out of reach surfaces and objects such as valances. When used as a standard upright, there is no necessity for the user to stoop or kneel.

By removing the carpet head, which is simply a pull apart operation, the machine is converted to use for cleaning valances and difficult to reach areas such as ceilings and the like. This simple conversion is made possible by the fact that the insertion port where the carpet head is inserted into the apparatus is itself configured as a cleaning tool. Thus, the carpet head tool is mounted within another too, making conversion of the apparatus from one type of cleaner to another very simple and direct.

By unlatching and removing the handle, the machine is converted into a compact, hand held vacuum cleaner for cleaning upholstery, furniture cushions and stair treads. This is made possible by making one end of the machines primary body a handle for the machine when using as a compact hand held unit and also as the anchor for the handle extension used when the machine is adapted to floor or ceiling use. Thus, one handle which creates one type of machine is removably mounted within another handle which, when the first handle is removed, creates a totally different type of machine.

DESCRIPTION OF THE PREFERRED EMBODIMENT

Figure 1:
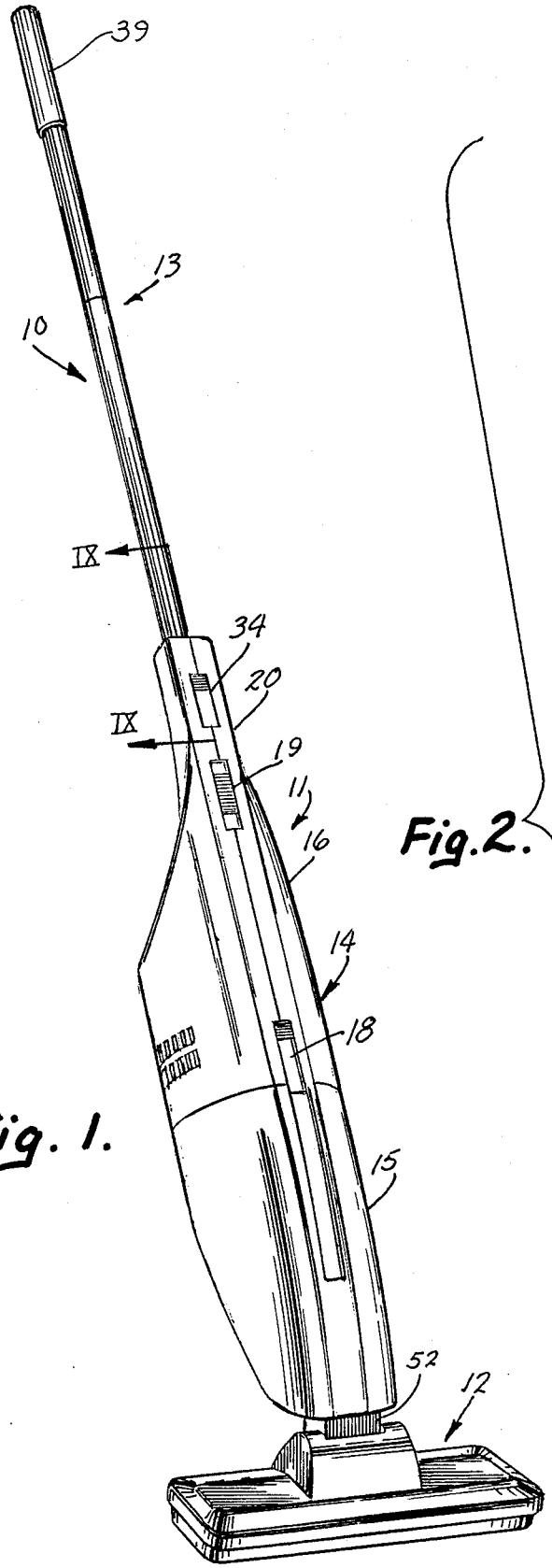
FIG. 1 is an oblique view of the vacuum cleaner embodying this invention.
Figure 2:
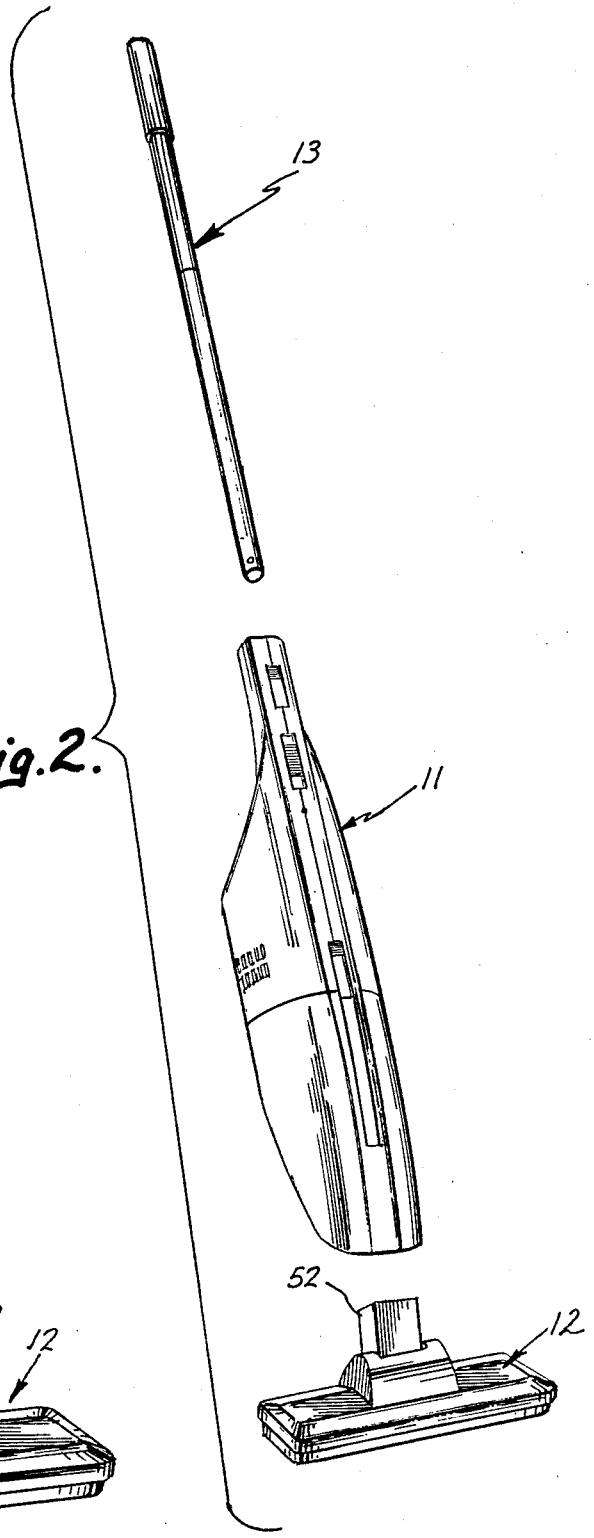
FIG. 2 is an exploded view of the vacuum cleaner illustrated in FIG. 1, shown on a reduced scale.

Referring to FIG. 1 the numeral 10 refers to a vacuum cleaner having a main body 11, a floor and carpet pickup head 12 and an extension handle 13. As is illustrated in FIG. 2 both the extension handle 13 and the pickup head 12 can be detached from the main body 11. The main body 11 has a two piece housing 14 with a front portion 15 and a rear portion 16 which are detachably latched together by an interfitting latch 17 at the bottom (FIG. 8) and a locking latch 18 at the top (FIG. 1). The locking latch has an operating lever which when depressed by the operator at its rear end releases the front portion providing access to the interior of the front portion. The interior of the front portion 15 serves as a collection chamber for the material such as dirt etc. picked up by the vacuum.

The vacuum is created by a motor driven air impeller housed in the front part of the rear portion 16 powered by a rechargeable battery pack also housed in the rear portion. The operation of the motor is controlled by a switch 19.

The rear end of the rear portion is shaped to provide a rearwardly extending primary handle 20 of a length and cross-sectional size and shape to be conveniently and comfortably held in the user's hand. The motor control switch 19 is mounted in the forward portion of this handle where the operator can maneuver it by use of the thumb.

Figure 6:
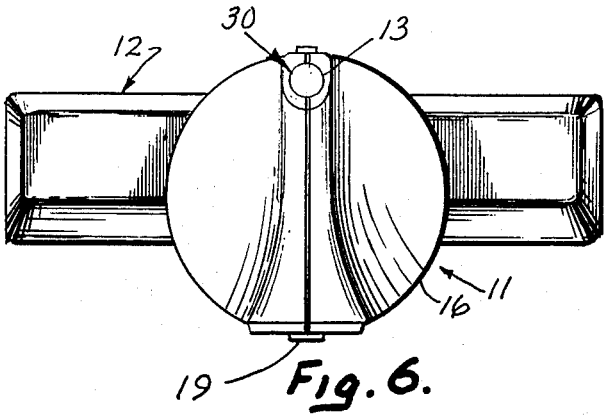
FIG. 6 is an end view taken along the plane VI—VI of FIG. 5.
Figure 9:
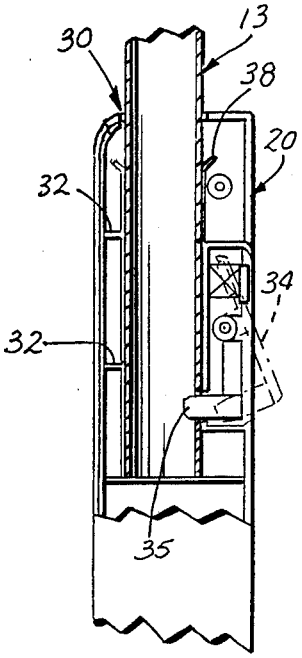
FIGS. 9 and 9A are enlarged fragmentary sectional views taken along the plane IX—IX of FIG. 1.
Figure 9A:
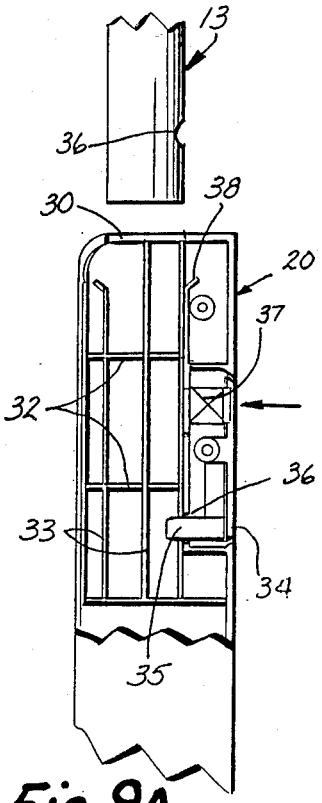

An opening 30 is provided in the rear end of the primary handle 20 of a size to telescopically receive the end of the wand-like secondary or extension handle 13 (FIG. 6). Within the handle 20, a plurality of spaced, circumferential ribs 32 and longitudinal stiffeners 33 form an elongated circular passageway or tunnel closely fitting about the extension handle 13, so that the extension handle, when fully inserted can firmly support the main body without conveying to the user any sense of looseness (FIGS. 9 and 9A). A latch 34 is pivotally mounted to the handle 20 and is provided with a finger 35 which seats in the latch opening 36 in the extension handle 13 (FIG. 9). The latch 34 is pivoted into locking engagement with the handle by a spring 37 (FIG. 9A). To facilitate entry of the end of the extension handle into the passageway at the top and bottom of the entry path inclined guide surfaces 38 are provided.

Figure 10:
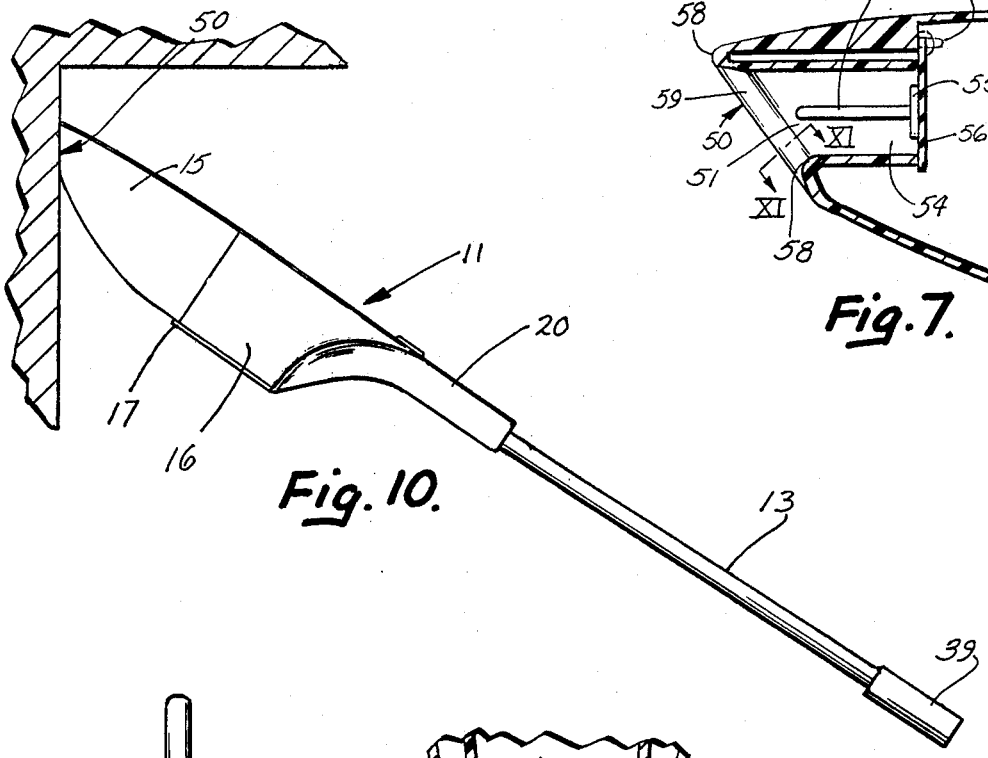
FIG. 10 is a side elevation view of the vacuum cleaner as it would appear while being used to vacuum the juncture of a wall and ceiling.

The length of the extension handle 13 is a matter of choice. A convenient length for normal household usage would be that which would make it easy to use the vacuum cleaner, with carpet head removed, to remove cobwebs at the ceiling/wall juncture in a room of standard ceiling height of eight feet as illustrated in FIG. 10 without requiring the operator to grip the handle at a point above the operator's head. It will be recognized that for use in older houses and some commercial facilities having higher ceilings such as 10 or 12 feet either a longer or a sectional handle could be provided and such would be within the scope of this invention. The end of the handle is provided with a suitable grip 39.

Figure 7:
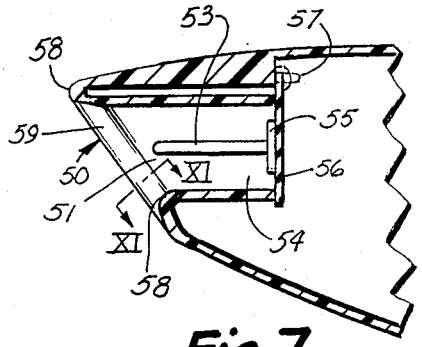
FIG. 7 is an enlarged, fragmentary sectional view taken along the plane VII—VII of FIG. 3.

The front or bottom face 50 of the main body is inclined rearwardly and downwardly from the upper or front face of the main body at an angle of about 45° (FIGS. 7 and 10). This inclination is such that the front face is generally parallel to the floor when the machine is being used to pick up dirt without use of the carpet head and with the operator holding the handle at a convenient angle while standing erect. It also permits this face to be generally parallel to a wall surface when the equipment is used to clean the upper portion of a wall surface in the manner illustrated in FIG. 10. It will also be observed from FIG. 10 that by inverting the vacuum cleaner about its longitudinal axis the inclination of the front face makes it convenient to use the machine for removing material clinging to the ceiling. This arrangement also makes the machine particularly effective for picking up floor spills such as cereal, ashes, crumbs or the like.

The face 50 has a central opening 51 which provides a restricted opening to the internal dirt collection chamber. Opening 51 is laterally elongated, specifically preferably rectangular, so as to improve the pick up characteristics when using face 50 and opening 51 as a pick up tool. The rectangular opening provides good equivalent orifice relative to the floor. Thus, when used for picking up spilled materials, a strong air current is generated in a small area capable of picking up relatively heavy items. Also, this type of strong air current is effective for removing lint and embedded dirt which tends to cling tenaciously to fabric surfaces such as pillow covers and upholstery.

Figure 4:
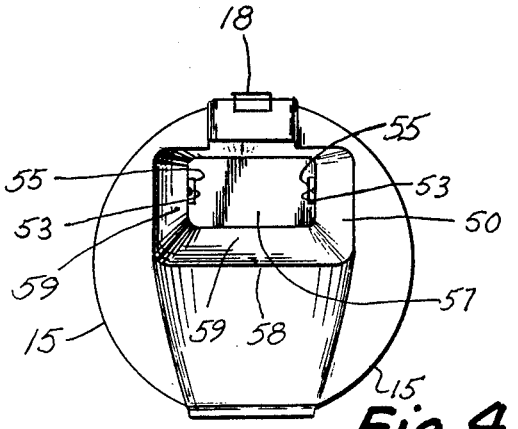
FIG. 4 is an end view taken along the plane IV—IV.
Figure 11:
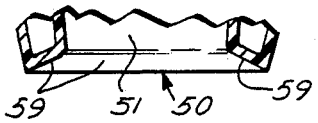
FIG. 11 is a fragmentary sectional view taken along the plane XI—XI of FIG. 7.

Opening 51 is framed by a generally rounded lip 58 and on three sides by inwardly beveled walls 59 (FIGS. 4, 7 and 11). Rounded lip 58 helps prevent the apparatus from scratching hard surfaces or becoming nagged in drapes or fabric, as often happens when one attempts to use the metal pipe of a canister vacuum as a tool. Preferably, walls 59 are beveled at a relatively shallow angle, preferably less than 45° but more than 15° to the plane of face 50, to enhance the rapid flow of air around edge 58 and into the generally rectangular throat 54 surrounding opening 51, which serves as a passageway for air being drawn into the interior dirt collection chamber of the apparatus.

To adapt the equipment to general use on floor surfaces, a pickup head attachment 12 equipped with a rectangular, tubular nozzle or coupling 52 is provided. The tubular nozzle is pivotally mounted to the floor engaging body of the head in a conventional manner. The tubular nozzle is coupled to the main body 11 by being telescopically inserted into the opening 51 where it presses firmly against the ribs 53 projecting from the walls of the throat 54 extending inwardly from the opening 51 (FIGS. 4 and 7). The engagement between the ribs 53 and the sides of the nozzle together with a small taper in the walls of the throat provide a firm but slidably disengageable anchor for the pickup head 12. Insertion of the nozzle is limited by the stops 55. At the inner end of the throat a flapper valve 56 is provided to prevent escape of the material collected in the dirt chamber when the motor is turned off. The flapper valve 56 is secured to the plastic posts 57 which are integral with the molded housing.

The pickup head is conventional in providing a means for causing a high velocity stream of air to pass through or close to the surface to be cleaned to entrain dirt and other materials on or in that surface.

All of the various parts of the main body 11 except the motor, the battery, the extension handle, wiring and incidental fasteners used for assembly are of molded plastic, thus, minimizing weight. The handle is preferably metal tubing for rigidity. The result is a very light weight machine which can be easily used without fatigue even when it is entirely supported by the operator as indicated in FIG. 10.

The invention provides a compact, unitized vacuum cleaner which the user carries as a single, light weight unit to the place where it is to be used. At the point of use, the operator adapts the machine to the particular requirements of the job. If it is removing a spill from the carpet the operator simply turns on the motor and uses the machine as is. If the spill has been embedded in a carpet surface, by removing the head 12, the displacement force of the vacuum can be concentrated by exposing the carpet surface to the opening 51 only. If it is to be used to remove a spider web or dust from a valance or the top of a picture or the top rail of panelling, the operator simply removes the carpet head 12 and proceeds with the job. If the job objective is vacuuming upholstery, such as to remove something spilled on it, in addition to removal of the carpet head 12, the extension handle 31 is removed and the main body of the machine is used as a compact hand vacuum while gripping it by the primary handle 20. In each case no accessories or extra equipment has to be brought with the machine.

Being of the cordless type, the accessibility of electrical power is irrelevant. The absence of extension cords significantly reduces the weight and pull exerted by the machine which must be supported by the operator. When the clean up is complete, if the machine has been taken apart, it can be reassembled for storage simply by reattaching the carpet head and the extension handle. When returned to storage, it is again recharged by inserting the charging unit in the charger connection 21

Figure 8:
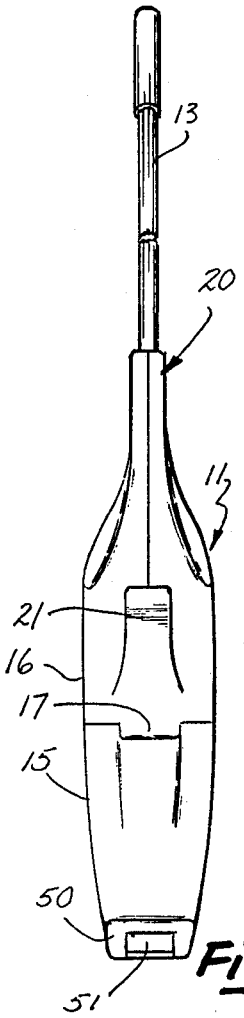
FIG. 8 is a broken bottom view of the vacuum cleaner with the carpet cleaning head removed.

(FIG. 8). Further, because the machine is a simple integrated, compact unit which is neither bulky nor of a complex shape, it occupies a minimum of storage space, an important feature in many homes, condominiums and apartments.

Having described a preferred embodiment of the invention, it will be understood that various modifications of it can be made without departing from the principles of the invention. Such modifications are to be considered as included in the hereinafter appended claims unless these claims, by their language, expressly state otherwise.

The embodiments of the invention in which an exclusive property or privilege is claimed are defined as follows:

1. A vacuum cleaner having a central body enclosing a material collection chamber; an air inlet orifice at one end of said central body and communicating with said collection chamber, said central body narrowing towards the end opposite said one end into a primary handle integral with said central body, said handle being elongated along an axis generally passing through said inlet orifice whereby said central body and integral handle comprise a sleek, compact vacuum cleaner; an extension handle and opening in the end of said primary handle centered on said axis for telescopically receiving an end of said extension handle, a latch for detachably locking said extension handle to said primary handle whereby said central body and its air inlet orifice can be made accessible to otherwise remote areas.

2. A vacuum cleaner as described in claim 1 wherein said inlet orifice is surrounded by an end face of said central body, said end face being inclined about 45° from a plane transverse to said central body and parallel to the longitudinal axis of the central body whereby said orifice is conveniently angled to serve as a floor engaging tool.

3. The vacuum cleaner of claim 2 in which said inlet orifice is generally rectangular in configuration with its longer dimension oriented transversely of the longitudinal axis of the vacuum cleaner.

4. The vacuum cleaner of claim 3 in which said inclined end face comprises a rounded lip joining the exterior of said central body to inwardly beveled walls located on at least three sides of said orifice.

5. A vacuum cleaner as described in claim 4 wherein a floor cleaning head is provided having a rectangular tubular nozzle of a size and shape to telescopically enter said orifice in said end face, said nozzle frictionally engaging the walls of said orifice with sufficient frictional resistance to movement to hold said nozzle in telescopic relationship with said central body during all normal floor and carpet cleaning operations.

6. A vacuum cleaner as described in claim 5 wherein a rectangular passageway extends toward the interior of said central body from said orifice, walls defining said passageway and defining an opening of a cross sectional size and shape to closely fit around and frictionally engage said nozzle; stop means at the inner end of said passageway for limiting inward telescopic movement of said nozzle.

7. A vacuum cleaner as described in claim 6 wherein a ridge extending lengthwise of said passageway protrudes into said passageway from opposite sides thereof for frictionally engaging said nozzle.

8. A vacuum cleaner as described in claim 5 in which said cleaning head further includes a floor engaging body and pivot means for joining said body to the nozzle of said head.

9. A vacuum cleaner as described in claim 1 wherein said primary handle has internally extending means forming an elongated internal tunnel forming a close fit with the end portion of said extension handle to provide rigid support for said central body said means including a plurality of spaced circumferential ribs and longitudinal stiffeners.

10. A vacuum cleaner as described in claim 1 wherein a switch is provided in said primary handle for controlling the operation of said motor.

11. A vacuum cleaner as described in claim 10 wherein both said switch and said extension handle latch are positioned in the top surface of said primary handle.

12. A vacuum cleaner as described in claim 1 wherein a cleaning head is provided having a tubular nozzle of a size and shape to telescopically enter said orifice in said end face, said nozzle frictionally engaging the walls of said orifice with sufficient frictional resistance to movement to hold said nozzle in telescopic relationship with said central body during all normal floor and carpet cleaning operations.

13. A vacuum cleaner as described in claim 12 wherein a passageway extends toward the interior of said central body from said orifice, walls defining said passageway and defining an opening of a cross sectional size and shape to closely fit around and frictionally engage said nozzle; stop means at the inner end of said passageway for limiting inward telescopic movement of said nozzle.

14. A vacuum cleaner as described in claim 12 wherein a ridge extending lengthwise of said passageway protrudes into said passageway from opposite sides thereof for frictionally engaging said nozzle.

15. A vacuum cleaner as described in claim 12 wherein pivot means is provided for joining said carpet cleaning head nozzle to the body of said head.

16. A vacuum cleaner having a central body enclosing a material collection chamber; a first air inlet orifice at one end of said central body and communicating with said collection chamber, a handle located generally towards the end of said central body opposite from said inlet orifice; said inlet orifice being surrounded by an end face of said central body, said end face being inclined about 45° from a plane tranverse to said central body and parallel to the longitudinal axis of the central body whereby said orifice is conveniently angled to serve as a floor engaging tool; a cleaning head having a tubular nozzle of a size and shape to telescopically enter said inlet orifice in said end face and a floor engaging body having a second air inlet orifice, said first orifice having an area substantially smaller than that of said second orifice to provide more concentrated displacement force when used alone than when used alternately with the cleaning head.

17. The vacuum cleaner of claim 16 in which said inclined end face comprises a rounded lip joining the exterior of said central body to inwardly beveled walls located on at least three sides of said first orifice.

18. The vacuum cleaner of claim 17 in which said first inlet orifice is generally rectangular in configuration with its longer dimension oriented transversely of the longitudinal axis of the vacuum cleaner.

19. A vacuum cleaner as described in claim 18 wherein a rectangular passageway extends toward the interior of said central body from said orifice, walls defining said first inlet passageway and defining an opening of a cross sectional size and shape to closely fit around and frictionally engage said nozzle; stop means at the inner end of said passageway for limiting inward telescopic movement of said nozzle.

20. A vacuum cleaner as described in claim 19 wherein a ridge extending lengthwise of said passageway protrudes into said passageway from opposite sides thereof for frictionally engaging said nozzle.

21. A vacuum cleaner as described in claim 20 wherein pivot means is provided for joining said cleaning head nozzle to the body of said head.

22. The vacuum cleaner of claim 16 in which said first inlet orifice is generally rectangular in configuration with its longer dimension oriented transversely of the longitudinal axis of the vacuum cleaner.

23. A vacuum cleaner having a central body enclosing a material collection chamber; an air inlet orifice at one end of said central body and communicating with said collection chamber, said central body narrowing towards the end opposite said one end into a primary handle integral with said central body, said handle being elongated along an axis generally passing through said inlet orifice whereby said central body and integral handle comprise a sleek, compact vacuum cleaner; an extension handle and an opening in the end of said primary handle centered on said axis for telescopically receiving an end of said extension handle whereby said central body and its air inlet orifice can be made accessible to otherwise remote areas.

* * * * *

UNITED STATES PATENT AND TRADEMARK OFFICE

CERTIFICATE OF CORRECTION

PATENT NO. : 4,766,638

DATED : August 30, 1988

INVENTOR(S) : David E. McDowell

It is certified that error appears in the above-identified patent and that said Letters Patent is hereby corrected as shown below:

Column 1, Line 68:

"too" should be --tool--

Figure 3:
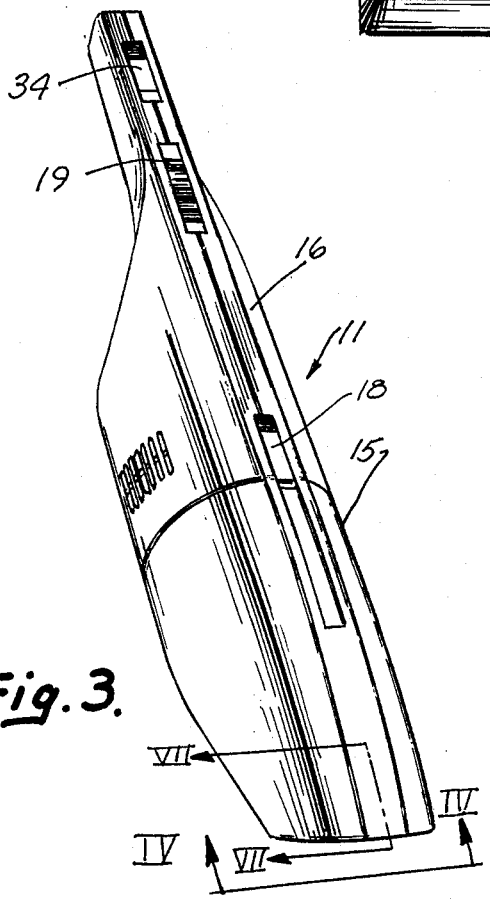
FIG. 3 is an oblique view of the main body of the vacuum cleaner.
Figure 5:
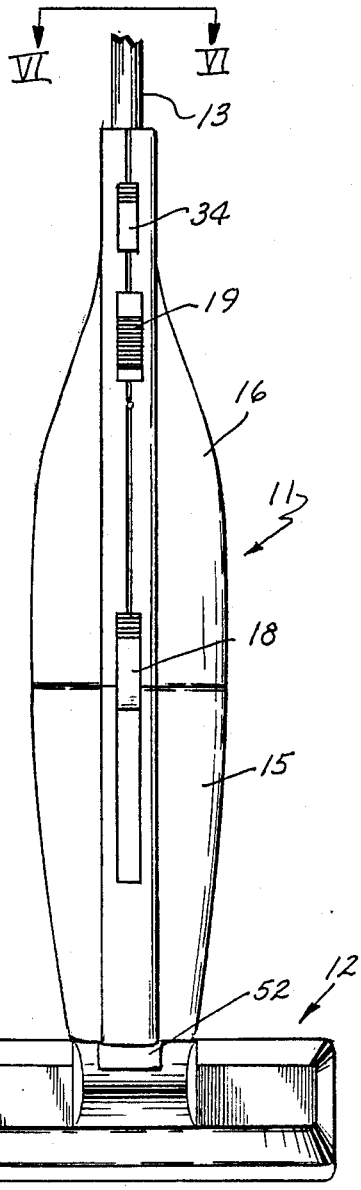
FIG. 5 is a fragmentary front view of the vacuum cleaner illustrated in FIG. 1.

Column 2, Line 23:

After "IV-IV" add --of Fig. 3--

Column 3, Line 67:

"nagged" should be --snagged--

Column 5, Claim 1, Line 25:

After "and" insert --an--

Signed and Sealed this

Seventeenth Day of April, 1990

*Attest:*

*Attesting Officer*

HARRY F. MANBECK, JR.

*Commissioner of Patents and Trademarks*